United States Patent [19]

Bako

[11] 4,125,282

[45] Nov. 14, 1978

[54] TURNBUTTON LATCH

[75] Inventor: Lazlo Bako, Woodcliff Lake, N.J.

[73] Assignee: Presto Lock Company, Division of Walter Kidde & Company, Inc., Garfield, N.J.

[21] Appl. No.: 811,304

[22] Filed: Jun. 29, 1977

[51] Int. Cl.[2] ..... E05C 3/14

[52] U.S. Cl. ..... 292/336

[58] Field of Search ..... 24/221; 292/336, 332, 292/334

[56] References Cited

U.S. PATENT DOCUMENTS

| | | | |
|---|---|---|---|
| 456,759 | 7/1891 | Cote | 292/336 |
| 2,487,895 | 11/1949 | Rounds | 24/221 R |
| 2,698,197 | 12/1954 | Jacobson | 292/336 |
| 3,909,888 | 10/1975 | Funston et al. | 292/204 X |

*Primary Examiner*—Richard E. Moore

*Attorney, Agent, or Firm*—Shapiro and Shapiro

[57] ABSTRACT

A turnbutton latch has an improved male part comprising a hollow stud supporting a turnbutton at one end of the stud. A bolt is fixed to the turnbutton within the stud, and a turnbutton spring biases the turnbutton to a closed position, at which the bolt depresses a trigger against the bias of a trigger spring. When the turnbutton is manually turned to open the latch, the trigger moves toward the turnbutton, blocking the bolt and preventing the turnbutton from closing the latch until the trigger is depressed. A female part placed over the turnbutton and the stud when the latch is open depresses the trigger to close the latch.

14 Claims, 10 Drawing Figures

TURNBUTTON LATCH

BACKGROUND OF THE INVENTION

This invention relates to turnbutton latches and is particularly concerned with the provision of a better turnbutton latch than has been available heretofore.

Turnbutton latches provide an easily operated latch of the push-to-close turn-to-open type that requires little manual dexterity, that resists opening during rough handling, and that is especially suitable for students' book bags and travel bags, for example. One type of prior turnbutton latch is disclosed in U.S. Pat. No. 2,487,895 to Rounds. In that latch a post of clover-leaf design integral with a base is concentric with a stud on which a locking member of similar design is mounted by means of a nut screwed onto the end of the stud. A coil spring supported concentrically in the stud has one end engaging the locking member to bias the locking member to a closed position and has the other end bent to form a trigger and also to form a catch which holds the locking member in its open position until the trigger is depressed by the female member of the latch. A pin projecting from the base into a slot of the locking member limits the turning movement of the locking member. In the device of Rounds a single spring must be critically shaped and relied upon to perform a plurality of functions. The device does not have a smooth exterior and is not constructed of parts that are easily mass-produced, easily assembled, and designed to perform their intended functions reliably over long periods of time.

Another type of turnbutton latch, presently marketed as part of a case for binoculars, provides a better exterior appearance, but the device is constructed almost entirely of sheet metal and has certain disadvantages. The turnbutton is a multi-part sheet metal shell supported on an end wall of a hollow sheet metal stud by means of a rivet which serves as a pivot for the turnbutton. A sheet metal tab of the turnbutton projects into an arcuate slot in the end wall of the stud and engages one arm of a wire spring which biases the turnbutton to its closed position. A sheet metal base closes the opposite end of the stud and supports a trigger, one part of which is fairly rigid sheet metal and another part of which is a leaf spring having a tab which enters a slot in the base to support the trigger on the base. A sheet metal lug of the trigger passes through a hole in the end wall of the stud and enters a hole in the turnbutton to retain the turnbutton in its open position until the trigger is depressed. When the turnbutton is turned from its closed position toward its open position, the lug is disengaged from the hole in the turnbutton by a camming action but then snaps into another hole of the turnbutton when the turnbutton reaches its open position. The construction of this type of turnbutton latch is rather flimsy and does not appear to be likely to provide reliable operation with rough handling over long periods of time. There is a gap between the opposing surfaces of the turnbutton and the stud, at which the tab can be seen extending from the turnbutton into the stud and the lug can be seen extending from the stud into the turnbutton, and the central rivet support for the turnbutton is inadequate to prevent some wobbling of the turnbutton.

BRIEF DESCRIPTION OF THE INVENTION

It is accordingly a principal object of the present invention to provide an improved male part of a turnbutton latch.

Another object of the invention is to provide a turnbutton latch in which most of the operating parts of the male part are hidden from view within a hollow stud and in which the turnbutton is supported on the hollow stud for smooth, precise, reliable turning movement.

Yet another object of the invention is to provide a turnbutton latch in which the stud and the turnbutton are each one-piece elements which may be readily produced by die casting, for example.

A further object of the invention is to provide a turnbutton latch in which the trigger is a rigid plate and in which a bolt fixed to the turnbutton within the stud cooperates with the trigger to hold the turnbutton in its open position until the trigger is depressed and then to hold the trigger depressed until the turnbutton is manually returned to its open position.

A still further object of the invention is to provide a turnbutton latch in which substantial movement of the trigger away from its depressed position when the turnbutton is turned to its open position provides a significant force to urge the female part off of the male part of the latch.

Briefly stated, from one of its broader aspects a turnbutton latch male part of the invention comprises a hollow stud having one end adapted to be mounted on a support and having a turnbutton mounted on the other end for limited turning movement between an open position at which a female part can be placed over the turnbutton and the stud and a closed position at which the turnbutton prevents removal of the female part from the stud, a bolt fixed to the turnbutton within the stud, first spring means in the stud biasing the turnbutton to the closed position, a trigger supported in the stud for movement toward and away from the turnbutton and having an end projecting through a slot at one side of the stud, second spring means within the stud biasing the trigger toward the turnbutton, and means including cooperating elements of the bolt and the trigger for holding the turnbutton in the open position until the trigger is moved away from the turnbutton.

BRIEF DESCRIPTION OF THE DRAWINGS

The invention will be further described in conjunction with the accompanying drawings, which illustrate a preferred and exemplary embodiment, and wherein.

DESCRIPTION OF THE PREFERRED EMBODIMENT

Figure 1:
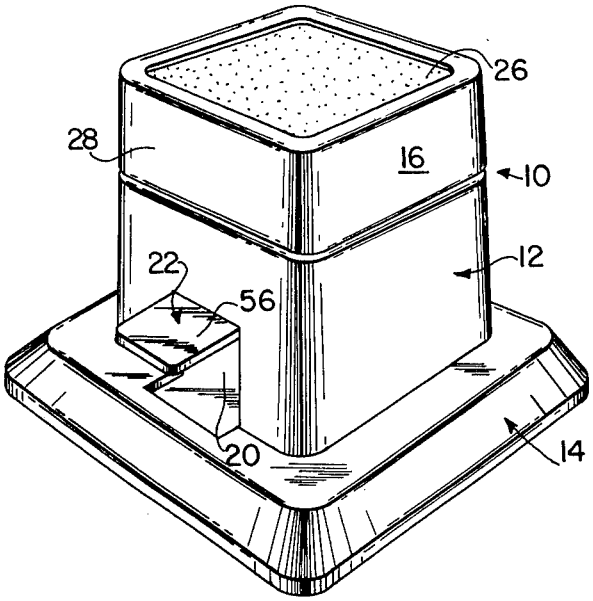
FIG. 1 is a perspective view illustrating the male part of a turnbutton latch of the invention in its open position.
Figure 2:
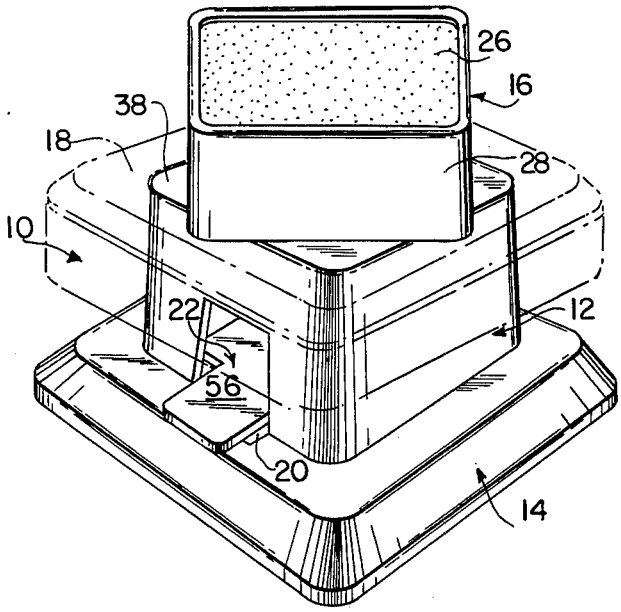
FIG. 2 is a similar view illustrating the latch in its closed position and showing in phantom lines the relationship of the male part to the female part of the latch.

Referring to FIGS. 1 and 2 of the drawings, the improved male part 10 of a turnbutton latch in accordance with the invention comprises a hollow stud 12 having a base 14 at one end and a turnbutton 16 at the other end. The base is adapted to be attached to a support, such as a panel or wall of a book bag, travel bag, or other support, as will be described more fully later. In the form shown the stud and the turnbutton are square in cross-section (as is the base) and are tapered somewhat, but the invention is not limited to this configuration. The stud and trunbutton may have any desired non-circular configuration; for example, fleur-de-lis, triangular, elliptical, etc.

To provide a smooth, attractive exterior that is easy to maintain, the outer contours of the turnbutton preferably form a continuation of the outer contours of the stud when the turnbutton is in the open position illustrated in FIG. 1. In the closed position illustrated in FIG. 2, elements of the turnbutton (the corners in this instance) project beyond sides of the stud so as to retain a female part 18 shown in phantom lines in FIG. 2. The female part may comprise an eyelet attached to a flap or cover of a case, such as a book bag, travel bag, etc., as is well known in the art. The hole in the female part is shaped to fit the stud somewhat loosely so that the female part may be readily placed over the male part when the turnbutton latch is in its open position (FIG. 1) but is small enough so that the projecting elements of the turnbutton prevent removal of the female part from the male part when the turnbutton latch is in its closed position (FIG. 2).

As shown in FIGS. 1 and 2, the stud has a rectangular slot 20 through one side wall thereof, through which a trigger 22 projects. In the open position of the turnbutton latch (FIG. 1), the trigger is biased to one end of slot 20 by a trigger spring (to be described), and in the closed position (FIG. 2) the trigger is held at the other end of slot 20 in a manner to be described.

Figure 7:
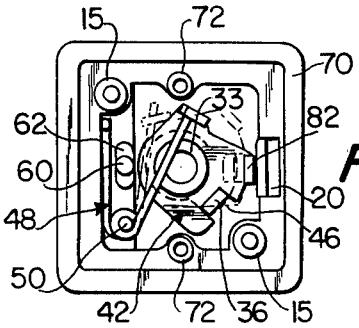
FIG. 7 is a bottom plan view of the stud showing, in the interior, the bolt and the turnbutton bias spring, the trigger and the trigger bias spring being removed for illustrative purposes.
Figure 3:
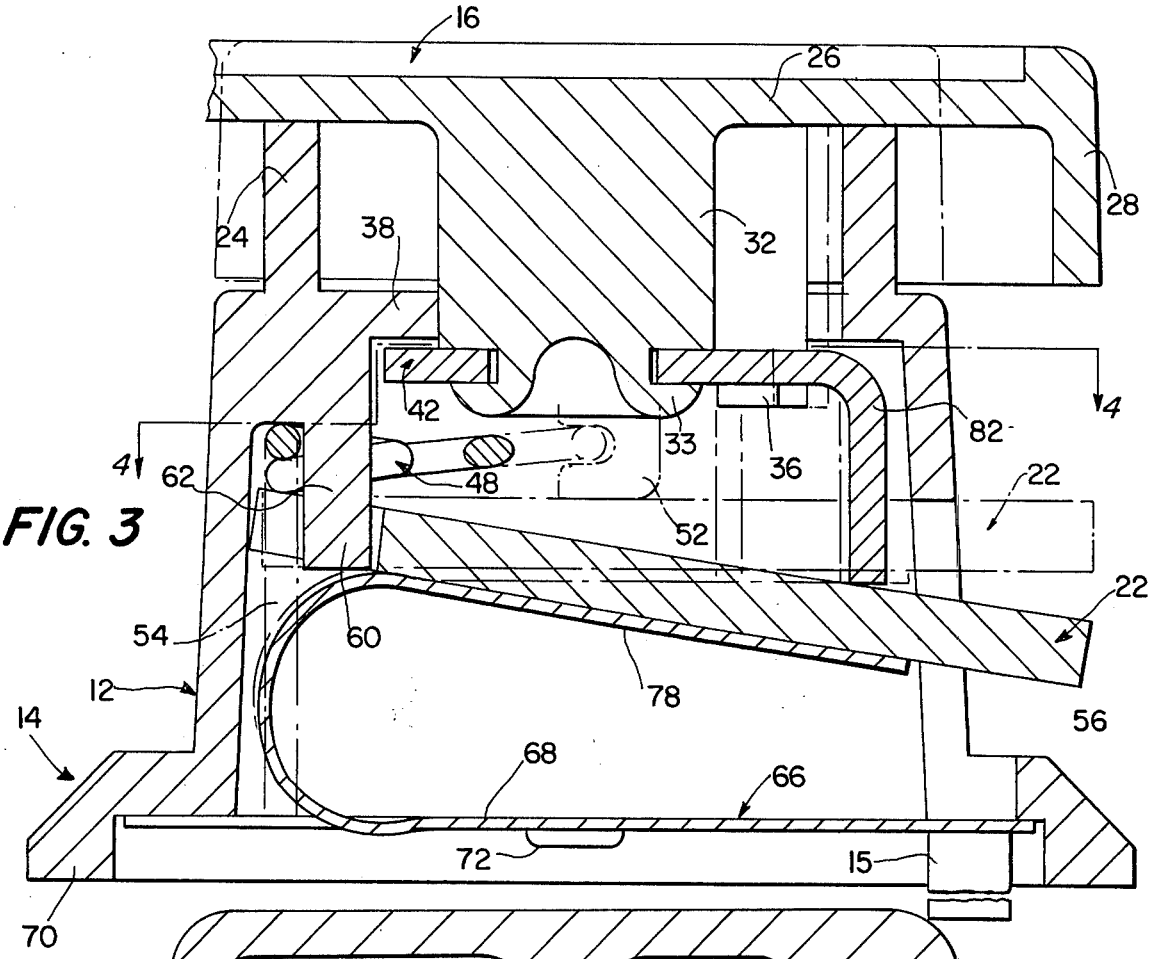
FIG. 3 is a vertical sectional view on an enlarged scale of the male part of the latch, which is shown oriented vertically for illustrative purposes, the latch being shown closed.

In the preferred form of the invention, the hollow stud 12 (including the integral base 14) and the turnbutton 16 are each single piece elements. Each may be die cast of an appropriate metal and plated to furnish a suitable finish. If desired, the hollow stud and turnbutton may be molded of a suitable plastic or synthetic resin composition. As shown in FIGS. 3 and 7, the base 14, at one end of stud 12, may have projecting bosses 15 for mounting the stud on a support (not shown). Two such bosses are shown in the illustrative form of the invention and may be received in corresponding holes of a cooperating mounting plate (not shown) at the side of a supporting wall opposite to that from which the male part 10 projects. Self-tapping screws may then be inserted through the mounting plate and into bosses 15 to fix the male part 10 to the supporting wall.

Figure 6:
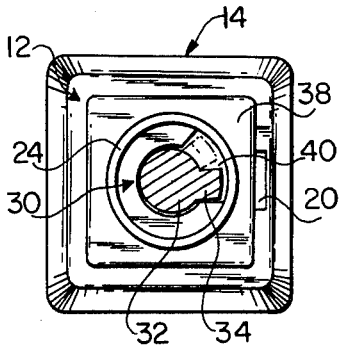
FIG. 6 is a top plan view of the stud, with a boss of the turnbutton shown in section.
Figure 5:
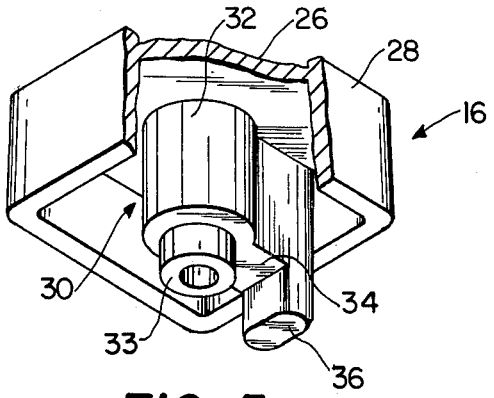
FIG. 5 is a perspective view, partly in section, of the turnbutton showing the underside which faces the stud.

As shown in FIGS. 3 and 6, at its other end, the stud 12 has a projecting cylindrical rim 24 on which the turnbutton 16 is mounted. In the form shown, the turnbutton has an end wall 26 which is supported on rim 24 and has a skirt 28 which covers the rim. The outer contours of the skirt complement those of the stud 12, as stated previously. The turnbutton is also formed with a boss 30 (see FIG. 5) having a cylindrical central portion 32 which has a closing shank 33 that may be expanded to attach the turnbutton to a bolt described hereinafter. A radial portion 34 of boss 30 has a depending lug 36 for keying the turnbutton to the bolt so that both these parts turn together.

As shown in FIG. 6, the hollow stud 12 has a top wall 38 (see FIG. 3 also) from which rim 24 projects. The top wall has an opening 40 which is preferably keyhole-shaped. A central circular portion of opening 40 receives the cylindrical portion 32 of boss 30 of the turnbutton and provides a bearing for the turning movement of the turnbutton. A diverging outer portion of opening 40 receives the radial portion 34 of boss 30 and has extremities which engage that portion of the boss to limit the turning movement of the turnbutton (to about 45° in the illustrative form of the invention). The solid line showing of the boss in FIG. 6 corresponds to the open position of the turnbutton latch (FIG. 1) and the phantom line showing of the boss in FIG. 6 corresponds to the closed position of the latch (FIG. 2).

Figure 8:
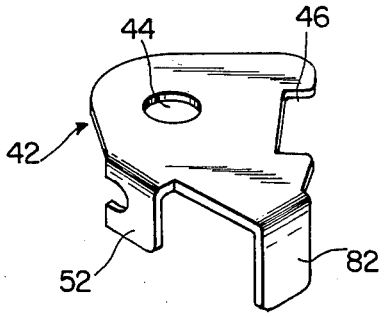
FIG. 8 is a perspective view of the bolt.

FIG. 8 illustrates the bolt 42, which is attached to the turnbutton. The bolt may be a steel stamping, for example, in the form of a plate with an opening 44 for receiving the closing shank portion 33 of the turnbutton, as shown in FIG. 3. Expansion of the closing shank assembles the bolt with the turnbutton, and since the dimensions of the bolt are larger than those of the opening 40 in the top wall 38 of stud 12, the turnbutton is thus attached to the stud. Lug 36 of the turnbutton enters a cooperating notch 46 of the bolt, keying the turnbutton to the bolt for joint turning movement. See FIGS. 4 and 7.

Figure 4:
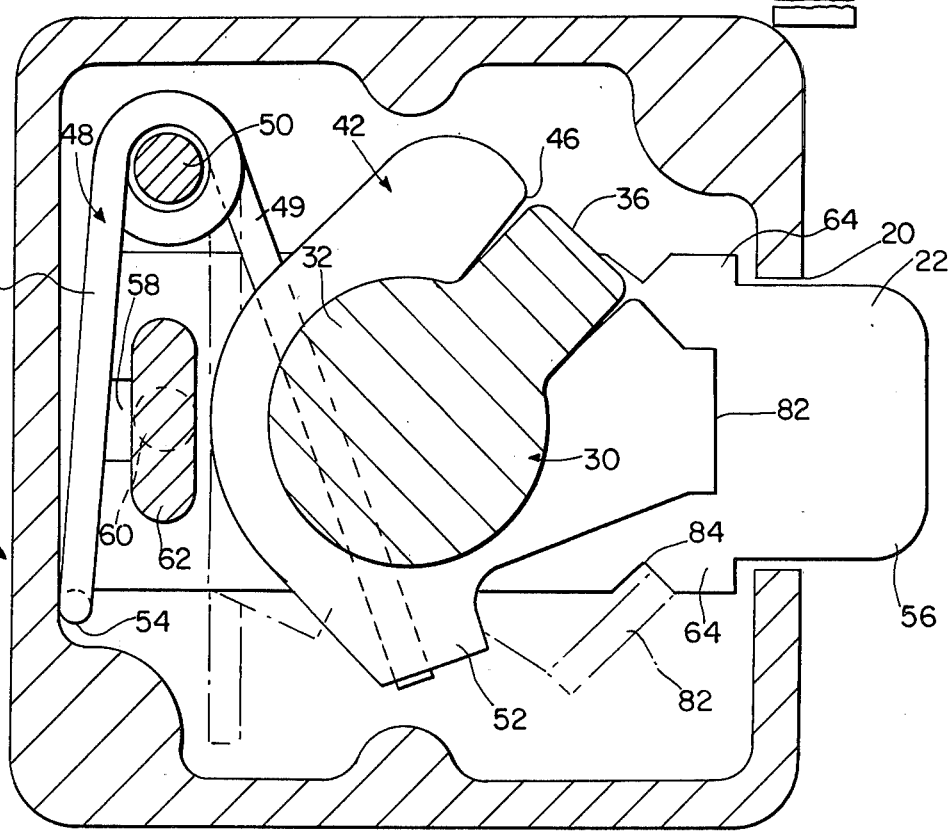
FIG. 4 is a horizontal sectional view taken along line 4—4 of FIG. 3.

The turnbutton is spring loaded by means of a turnbutton spring 48 (FIGS. 3, 4, and 7). The spring is preferably a wire torsion spring having a helical center section supported upon a post 50 projecting from an interior surface of stud 12 and having a pair of diverging legs, one of which, 49, engages a notched lug 52 of bolt 42 and the other of which, 51, engages the inner surface of a side wall of stud 12. To assist in handling and positioning the spring, one of the legs may have a right angle bend 54 shown in phantom lines in FIG. 3. Spring 50 biases the turnbutton to its closed position (FIG. 2). In this position of the turnbutton, bolt 42 assumes the position shown in solid lines in FIGS. 4 and 7.

Figure 10:
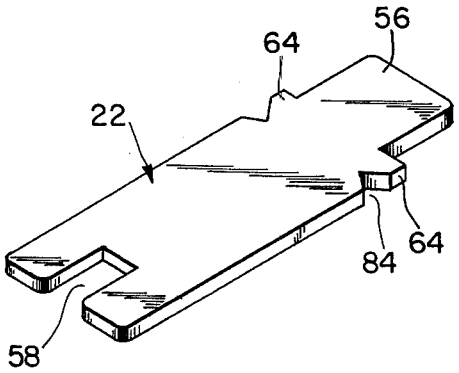
FIG. 10 is a perspective view of the trigger.

The trigger 22 previously mentioned is shown in detail in FIG. 10. In the preferred form the trigger is a rigid plate, such as a steel stamping which may be plated. It is of generally rectangular outline and has one end 56 which projects from slot 20 of stud 12 as previously described. The other end may be provided with a notch 58 which fits over a post 60 projecting from an interior surface of the hollow stud 12 as shown in FIGS. 3, 4, and 7. The post is preferably enlarged at its root, as shown at 62, to complete a support for the trigger. The trigger has sufficient freedom for pivotal movement on this support so that the projecting end 56 may move in slot 20 toward and away from the turnbutton 16. Ears 64 formed on the trigger keep the trigger from escaping from stud 12 through slot 20, as shown in FIG. 4.

Figure 9:
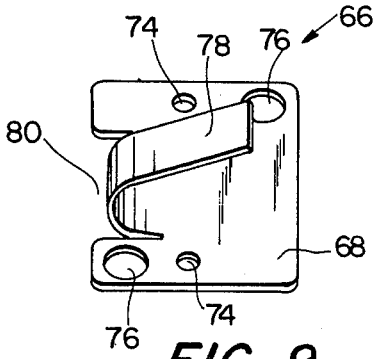
FIG. 9 is a perspective view of the trigger bias spring.

The trigger is constantly biased toward the turnbutton by a trigger spring 66. See FIGS. 3 and 9. The trigger spring is preferably blanked from flat spring stock and has a base portion 68 which fits within the rim 70 of base 14 of the stud 12 and which closes the base opening in the hollow stud. Closing shanks 72 integral with base 14 enter openings 74 in spring 66 and are expanded to hold the spring in position. Holes 76 pass the bosses 15 previously described. The active part of spring 66 is a leaf 78 curving away from the base part 68, which is notched at 80 for this purpose.

Leaf 78 engages one side of trigger 22 as shown in FIG. 3, thereby urging the trigger toward turnbutton 16. When the turnbutton is closed (FIG. 2) a tab 82 of bolt 42 (FIG. 8) engages the opposite side of the trigger 22 and depresses the trigger, against the bias of spring 66, as shown in full lines in FIG. 3. When the turnbutton is placed in the open position (FIG. 1) tab 82 turns sufficiently to release the trigger, which moves toward the turnbutton as shown in phantom lines in FIG. 3. The tab is then located adjacent to an edge of the trigger in a notch 84 of the trigger, as shown in phantom lines in FIG. 4 and is blocked by the trigger. The turnbutton is thus restrained from moving to its closed position under the bias of its spring 48.

In the operation of the device, the turnbutton 16 is turned manually to its open position (FIG. 1). When the female part 18 is placed over the turnbutton 16 and the stud 12 and depresses the trigger 22, the trigger no longer blocks tab 82, and the bolt 42 is free to turn under the bias of spring 48. The turnbutton thus turns automatically to the closed position shown in FIG. 2. Tab 82 slides onto the trigger and maintains the trigger depressed. The female part of the latch, which now is restrained by the corners of turnbutton 16, fits on the stud somewhat loosely and does not itself hold the trigger depressed, at least not to the extent to which the trigger is held depressed by tab 82.

To open the latch, the turnbutton is turned manually from the position of FIG. 2 clockwise to the position of FIG. 1. As tab 82 passes off of trigger 22, trigger spring 66 snaps the trigger toward the turnbutton 16 and at least partially ejects the female part from the male part of the turnbutton latch. The female part may then be freely removed from the male part.

As is now apparent, the moving parts within stud 12 are hidden from view and are shielded from adverse external forces. The turnbutton and the hollow stud may be formed as sturdy single pieces, and the turnbutton is securely supported on the stud for precise turning movement, providing, together with the stud, smooth, attractive external contours. The trigger is a separate rigid member which is constructed to perform its intended function reliably over a long period. Similarly, each of the bias springs is especially adapted to perform its intended function reliably for years, and the trigger spring also serves to close the open end of the hollow stud. The bolt, which coacts with the trigger to hold the turnbutton in its open position and to depress the trigger in the closed position of the turnbutton (to provide the ejection action described above) is completely housed within the hollow stud and also serves to retain the turnbutton on the stud.

While a preferred embodiment of the invention has been shown and described, it will be apparent to those skilled in the art that changes can be made in this embodiment without departing from the principles and spirit of the invention, the scope of which is defined in the appended claims.

The invention claimed is:

1. A turnbutton latch male part comprising a hollow stud having one end adapted to be mounted on a support and having a turnbutton mounted on the other end for limited turning movement between an open position at which a female part can be placed over said turnbutton and said stud and a closed position at which said turnbutton prevents removal of the female part from said stud, a bolt fixed to said turnbutton within said stud, first spring means in said stud biasing said turnbutton to said closed position, a trigger supported in said stud for movement toward and away from said turnbutton and having an end projecting through a slot in a side wall of said stud, second spring means within said stud biasing said trigger toward said turnbutton, and means including cooperating elements of said bolt and said trigger for holding said turnbutton in said open position until said trigger is moved away from said turnbutton.

2. A turnbutton latch male part in accordance with claim 1, wherein said means for holding said turnbutton in its open position comprises a tab extending from the bolt and blocked by the trigger when the turnbutton is in its open position.

3. A turnbutton latch male part in accordance with claim 1, further comprising means including cooperating elements of said bolt and said trigger for holding said trigger away from said turnbutton against the bias of said second spring means when the turnbutton is in its closed position but releasing the trigger when the turnbutton is turned to its open position.

4. A turnbutton latch male part in accordance with claim 3, wherein said means for holding said trigger away from said turnbutton comprises a tab on said bolt engaging one side of the trigger when the turnbutton is in its closed position.

5. A turnbutton latch male part in accordance with claim 1, wherein said stud has an annular rim at said other end for supporting said turnbutton.

6. A turnbutton latch male part in accordance with claim 5, wherein said turnbutton has an end wall supported on said rim and has a skirt covering the rim.

7. A turnbutton latch male part in accordance with claim 6, wherein said stud and said turnbutton are of complementary square cross-section.

8. A turnbutton latch male part in accordance with claim 5, wherein said stud has an end wall adjacent to said turnbutton from which said rim projects.

9. A turnbutton latch male part in accordance with claim 8, wherein said end wall of said stud has a keyhole-shaped opening therethrough and said turnbutton has a boss projecting into said opening, said boss having a cylindrical portion fitting a corresponding circular portion of the opening to provide a bearing for the turning movement of the turnbutton, the boss having a radial portion located in a diverging portion of the opening for limiting the turning movement of the boss in the opening, the boss having a lug engaging a notch in the bolt whereby the bolt is constrained to turn with the turnbutton.

10. A turnbutton latch male part in accordance with claim 9, wherein said bolt comprises a plate fixed to said boss at the side of the end wall of the stud opposite to the turnbutton, the plate being larger than the opening, whereby the turnbutton is retained on the stud.

11. A turnbutton latch male part in accordance with claim 1, wherein said trigger is a rigid plate and said second spring means comprises a leaf portion engaging the trigger and a base portion substantially closing said one end of the stud.

12. A turnbutton latch male part in accordance with claim 1, wherein said first spring means is a torsion spring having a helical portion supported upon a post in the stud and having opposite arms, one of which engages an interior surface of the stud and the other of which engages a lug on the bolt.

13. A turnbutton latch male part in accordance with claim 1, wherein the stud and the turnbutton are each a one-piece casting.

14. A turnbutton latch male part in accordance with claim 4, wherein said means for holding the turnbutton in its open position comprises said tab and an edge of the trigger which engages and blocks the tab when the turnbutton is in its open position.

* * * * *